US008499599B2

(12) United States Patent
Cheng et al.

(10) Patent No.: US 8,499,599 B2
(45) Date of Patent: Aug. 6, 2013

(54) LASER-BASED THREE-DIMENSIONAL HIGH STRAIN RATE NANOFORMING TECHNIQUES

(75) Inventors: Gary J. Cheng, West Lafayette, IN (US); Huang Gao, West Lafayette, IN (US); Yingling Yang, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 269 days.

(21) Appl. No.: 13/113,408

(22) Filed: May 23, 2011

(65) Prior Publication Data

US 2011/0283762 A1 Nov. 24, 2011

Related U.S. Application Data

(60) Provisional application No. 61/347,564, filed on May 24, 2010.

(51) Int. Cl.
*B21D 26/02* (2011.01)
*B21J 5/04* (2006.01)

(52) U.S. Cl.
USPC ..... 72/56; 72/54; 72/60; 72/379.2; 72/430; 29/421.1; 29/421.2

(58) Field of Classification Search
USPC 72/54, 56, 57, 60, 379.2, 430, 706; 29/421.1, 29/421.2
See application file for complete search history.

(56) References Cited

U.S. PATENT DOCUMENTS 3,739,614 A * 6/1973 Cranston ..... 72/56
6,227,023 B1 * 5/2001 Daehn et al. ..... 72/57
7,282,456 B2 * 10/2007 Chou et al. ..... 438/760
7,579,399 B2 * 8/2009 Mekkaoui Alaoui et al. ..... 72/379.2
7,691,731 B2 * 4/2010 Bet et al. ..... 438/479
8,015,849 B2 * 9/2011 Jones et al. ..... 72/56
8,085,406 B2 * 12/2011 Petek et al. ..... 356/450
8,227,325 B2 * 7/2012 Bet et al. ..... 438/479

OTHER PUBLICATIONS

P. Nagpal, N. C. Lindquist, S. H. Oh, D. J. Norris, Ultrasmooth Patterned Metals for Plasmonics and Metamaterials, Science 325, 594 (Jul. 2009).

M. Li, T. S. Mayer, J. A. Sioss, C. D. Keating, R. B. Bhiladvala, Template-Grown Metal Nanowires as Resonators: Performance and Characterization of Dissipative and Elastic Properties, Nano Letters 7, 3281 (Nov. 2007).

(Continued)

*Primary Examiner* — David B Jones

(74) *Attorney, Agent, or Firm* — Anthony P. Filomena; Taft, Stettinius & Hollister, LLP

(57) ABSTRACT

A laser nanoforming system and method for forming three-dimensional nanostructures from a metallic surface. A laser beam is directed to hit and explode an ablative layer to generate a shockwave that exerts a force on the metallic surface to form an inverse nanostructure of an underlying mold. A dry lubricant can be located between the metallic surface and mold to reduce friction. A confinement layer substantially transparent to the laser beam can confine the shockwave. A cushion layer can protect the mold from damage. A flyer layer between the ablative layer and metallic surface can protect the metallic surface from thermal effects of the exploding ablative layer. The mold can have feature sizes less than 500 nm. The metallic surface can be aluminum film. The dry lubricant can be sputtered Au—Cr film, evaporated Au film or a dip-coated PVP film or other dry lubricant materials.

20 Claims, 5 Drawing Sheets

OTHER PUBLICATIONS

E. Ozbay, Plasmonics: Merging Photonics and Electronics at Nanoscale Dimensions, Science 311, 189 (Jan. 2006).
C. Genet, T. W. Ebbesen, Light in tiny holes, Nature 445, 39 (Jan. 2007).
H. A. Atwater, A. Polman, Plasmonics for improved photovoltaic devices, Nature Materials 9, 205 (Mar. 2010).
Polman, Plasmonics Applied, Science 322, 868 (Nov. 2008).
D. P. Sanders, Advances in Patterning Materials for 193 nm Immersion Lithography, Chemical Reviews 110, 321 (Jan. 2010).
D. Gates et al., New Approaches to Nanofabrication: Molding, Printing, and Other Techniques, Chemical Reviews 105, 1171 (Apr. 2005).
H. Schift, Nenoimprint lithography: An older story in modern times? A review, Journal of Vacuum Science & Technology B 26, 458 (Mar.-Apr. 2008).
S. H. Ko et al., Direct Nanoimprinting of metal Nanoparticles for Nanoscale Electronics Fabrication, Nano Letters 7, 1869 (Jul. 2007).
G. Kumar, H. X. Tang, J. Schroers, Nanomoulding with amorphous metals, Nature 457, 868 (Feb. 2009).
U. Engel, R. Eckstein, Microforming—from basic research to its realization, Journal of Materials Processing Technology 125, 35 (Sep. 2002).
F. Vollertsen, H. S. Niehoff, Z. Hu, State of the art in micro forming, International Journal of Machine Tools & Manufacture 46, 1172 (Sep. 2006).
H. B. Shim, Improving Formability to Develop Miniature Stamping Technologies, International Journal of Precision Engineering and Manufacturing 10, 117 (Apr. 2009).
F. Vollertsen, D. Biermann, H. N. Hansen, I. S. Jawahir, K. Kuzman, Size effects in manufacturing of metallic components, Cirp Annals-Manufacturing Technology 58, 566 (2009).
S. W. Pang, T. Tamamura, M. Nakao, A. Ozawa, H. Masuda, Direct nano-printing on Al substrate using a SiC mold, Journal of Vacuum Science & Technology B 16, 1145 (May-Jun. 1998).
K. A. Lister et al., Direct imprint of sub-10 nm features into metal using diamond and SIC stamps, Journal of Vacuum Science & Technology B 22, 3257 (Nov.-Dec. 2004).
G. J. Cheng, D. Pirzada, Z. Ming, Microstructure and mechanical property characterizations of metal foil after microscale laser dynamic forming, Journal of Applied Physics 101, (Mar. 2007).
J. Yu, H. Gao, H. Y. Yu, H. Q. Jiang, G. J. Cheng, Laser dynamic forming of functional materials laminated composites on patterned three-dimensional surfaces with applications on flexible microelectromechanical systems, Applied Physics Letters 95, (Aug. 2009).
R. Fabbro, J. Fournier, P. Ballard, D. Devaux, J. Virmont, Physical study of laserproduced plasma in confined geometry, Journal of Applied Physics 68, 775 (Jul. 1990).
M. Seth, V. J. Vohnout, G. S. Daehn, Formability of steel sheet in high velocity impact, Journal of Materials Processing Technology 168, 390 (Oct. 2005).
G. S. Daehn, V. J. Vohnout, S. Datta, Hyperplastic Forming: Process Potential and Factors Affecting Formability, in Superplasticity—Current Status and Future Potential, P. B. Berbon, M. Z. Berbon, T. Sakuma, T. G. Langdon, Eds. (2000), vol. 601, pp. 247-252.
V. B. Shenoy, L. B. Freund, Necking bifurcations during high strain rate extension, Journal of the Mechanics and Physics of Solids 47, 2209 (Nov. 1999).

* cited by examiner

LASER-BASED THREE-DIMENSIONAL HIGH STRAIN RATE NANOFORMING TECHNIQUES

CROSS-REFERENCE TO RELATED APPLICATIONS

This application claims the benefit of U.S. Provisional Application Ser. No. 61/347,564, filed on May 24, 2010, entitled "Laser Based 3D High Strain Rate Nanoforming Techniques" which is incorporated herein by reference.

BACKGROUND

The present invention generally relates to techniques for forming three-dimensional (3D) nanostructures by employing dry lubricant and high speed shock, and more particularly to methods for fabricating metal nanopatterns using laser induced shockwaves.

Metal forming has always played an important role within the manufacturing industry because of its multiple advantages, including low cost, low waste, smooth surface, high speed and high uniformity. However, nanoscale metal forming is very difficult because of the limited formability arising from size effects. Because of these difficulties, it would be desirable to design a more effective nanoscale metal forming technique.

Due to high mechanical strength, nonlinear optical response, high electrical and thermal conductivity, nanoscale metallic structures are of considerable interest to broad fields, including plasmonics and nanoelectromechanical systems (NEMS). Promising versatile applications are proposed, ranging from biosensors, photovoltaic devices to subwavelength optical devices. To realize the potential of these materials, there is a need to develop low cost and high-throughput techniques that can engineer complex nanostructures on metal surfaces. Although various approaches such as lithography and microcutting have been developed to generate nano metallic features, such approaches usually have issues including high equipment costs, requirements for heating and etching, as well as structural and material limitations. In addition, quasi-3D structures by these methods can have problems satisfying the requirements in more complicated and integrated systems. Furthermore, to increase reliability and robustness, there is a need to fabricate metallic nanocomponents with higher strength, longer life, and better precision. Recently, to alleviate the limitations, metal nanoparticle solution and amorphous metal glass have been used as starting materials for fabricating metallic nanostructures.

Forming technology will be well-suited for mass production of small-size features because of its high production output and material integrity. One of the most important advantages of such techniques is that they can shape and strengthen metal components simultaneously due to strain hardening effects. However, investigations on microforming processes have revealed that forming operations are not easily scaled down, particularly because the forming behaviors of these operations at small scales are significantly different from those at the conventional length scales. A few groups have tried to pattern simple linear arrays on surfaces of metallic foils by using direct cold forming. Though extra-hard molds (diamond, SiC) were utilized, distortion of the patterns and damage of molds were encountered in these experiments, which prevented these approaches from being widely adopted.

Experiments disclosed herein have demonstrated that a laser induced shockwave can successfully stamp metal and function materials with micro-scale and meso-scale features. However, it presents very significant technical challenges to obtain nanoscale metallic features with complex shape and high aspect ratio at nano levels. The difficulty of deforming metal materials at nanoscale is mostly due to the limited formability arising from size effects. These effects occur when the sizes of mold cavities are close or smaller than those of metallic grain. The present system and method are intended to improve upon and resolve some of these known deficiencies.

SUMMARY

A rapid fabrication technique is disclosed that employs dry lubricant and a high speed shock. It has been determined that the combination of high strain rate and low friction improves the formability of metallic film, thereby minimizing conventional problems related to metal nanoforming and microforming. For example, by using laser as a high rate energy source, high-resolution (<50 nm), high aspect ratio (>2) and complex 3D structures were directly shaped in a very short duration (<100 ns). Neither heating nor etching was required in the method, and thus it is energy saving and environmentally friendly compared with lithography-based approaches. Furthermore, this technique (referred to as "Laser Nanoforming (LNF)"), can improve the mechanical strength of a resultant nanostructure because of its strain hardening effect.

A method for forming three-dimensional nanostructures is disclosed that includes directing a laser beam along an optical path to hit an ablative layer; causing the ablative layer to vaporize into plasma and explode due to the laser beam, the exploding ablative layer generating a shockwave; confining the shockwave; subjecting a metallic surface to the shockwave; and exerting a force on the metallic surface with the shockwave to form an inverse three-dimensional nanostructure of an underlying mold.

A laser nanoforming system for forming three-dimensional nanostructures is disclosed that includes an underlying mold, an ablative layer, a metallic surface located between the ablative layer and the underlying mold, and a laser generating a laser beam to hit the ablative layer and cause the ablative layer to vaporize into plasma and explode to generate a shockwave. The shockwave exerts a force on the metallic surface to form an inverse three-dimensional nanostructure of the underlying mold.

A dry lubricant layer can be located between the metallic surface and the underlying mold to reduce friction between the metallic surface and the underlying mold. A confinement layer that is substantially transparent to the laser beam can be used to confine the shockwave. The ablative surface can be located between the confinement layer and the metallic surface. A cushion layer can be located under the underlying mold to protect the underlying mold from damage. A flyer layer can be located between the ablative layer and the metallic surface to protect the metallic surface from thermal effects of the exploding ablative layer. A focus lens can be used to control the beam size of the laser beam. The underlying mold can include feature sizes less than 500 nm and can be made of silicon. The metallic surface can be an aluminum film surface. The dry lubricant layer can be a sputtered Au—Cr film, an evaporated Au film and a dip-coated PVP film, or other dry lubricant materials. The thickness of the dry lubricant layer can be between 20 nm and 80 nm.

DESCRIPTION OF EXEMPLARY EMBODIMENTS

Figure 1:
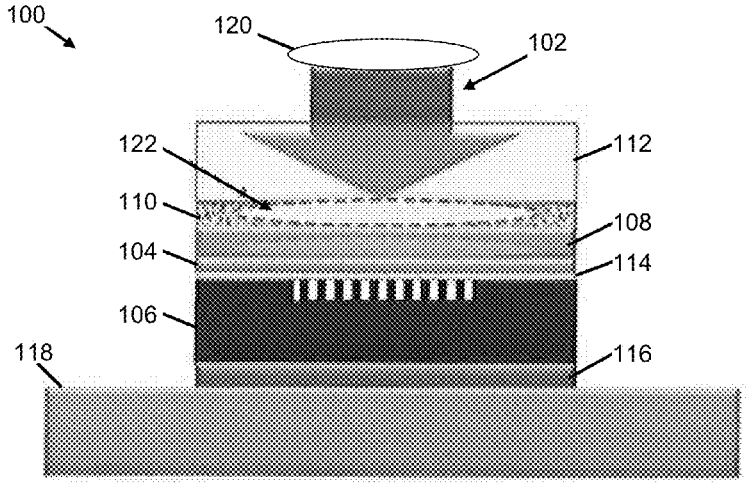
FIG. 1 illustrates and exemplary embodiment of a laser nanoforming system.

For the purposes of promoting an understanding of the principles of the novel technology, reference will now be made to the exemplary embodiments described herein and illustrated in the drawings and specific language will be used to describe the same. It will nevertheless be understood that no limitation of the scope of the novel technology is thereby intended, such alterations and further modifications in the illustrated devices and methods, and such further applications of the principles of the novel technology as illustrated therein being contemplated as would normally occur to one skilled in the art to which the novel technology relates.

A rapid laser-based process to engineer metallic film surfaces (hereinafter referred to as "nanoforming") is disclosed. Nanoforming can be used to create complex three-dimensional nanostructures on metallic films by a one-step processing technique. Unlike conventional processes, this technique is robust, energy saving and environmentally friendly, and also does not require heating or etching during the fabrication process. All of these advantages make this inventive technique distinctly unique and novel in view of other conventional processes.

While laser nanoforming can be considered a variant of nanoimprinting techniques, unlike traditional nanoimprinting approaches using hydraulic presses and polymers, laser nanoforming employs high velocity shock to directly shape metallic films at room temperature. One benefit of the present technique is that the combination of high strain rate and low friction remarkably improves the formability of the metallic films and protects the nanomold. As a result, brittle materials (such as silicon) can be used as a nanomold, which makes the technique more practical because of the fact that Si-based nanofabricaton techniques have been well-established. Furthermore, some untouched but significant research fields have been found during laser nanoforming processes, such as nanoscale deformation mechanisms of extended metal ductility under ultrahigh strain rate.

An exemplary embodiment of a laser nanoforming system 100 is shown in FIG. 1. The laser nanoforming system 100 includes a laser beam 102 directed at a workpiece 104 located above a mold 106. In this embodiment, a flyer layer 108 is located above the workpiece 106, an ablative coating 110 is located above the flyer layer 108 and a confinement layer 112 is located above the ablative coating 110. The confinement layer 112 is substantially transparent to the laser beam 102. A dry lubricant layer 114 is located between the workpiece 104 and the mold 106. In this embodiment, a cushion layer 116 is located below the mold 106 and the cushion layer 116 is located on an X-Y stage 118. A focus lens 120 can be used to control the beam size of the laser beam 102.

The laser-induced shockwave provides a high rate energy source for the forming process in which the forming velocity is mainly determined by the high velocity of the shockwave. This process can be simplistically summarized by the following three steps: 1) plasma formation; 2) shockwave generation and propagation; and 3) deformation of the workpiece. During operation, the laser beam 102 is directed along an optical path to pass through the focus lens 120. The laser beam 102 passes through the confinement layer 112 and hits a portion of the ablative coating 110. When the ablative coating 110 is exposed to the laser beam 102, the ablative coating 110 vaporizes and ionizes into a hot plasma plume 122 which explodes violently in the limited space between the confinement layer 112 and the workpiece 104 and continues absorbing the laser energy as the laser pulse 102 is applied. The confinement layer 112 confines the laser induced plasma plume 122 and creates a high-pressure condition above the workpiece 104 during the heating and condensing of the plasma 122. The sudden high pressure against the flyer layer 108 generates a shockwave that propagates down into the flyer layer 108, and the blocking of explosive vapor by the confinement layer 112 further magnifies and prolongs the shock pressure. The shockwave continues to travel through the protecting flyer layer 108 and exerts a force onto the workpiece 104, causing deformation of the workpiece 104. The workpiece 104 takes the inverse three-dimensional shape of the underlying mold 106.

To further take advantage of this high strain rate process, the dry lubricant layer 114 can be deposited on the workpiece 104 to reduce friction between the workpiece 104 and the underlying mold 106 and to utilize high velocity plastic flow of the workpiece 104. The cushion layer 116 can be used to protect the mold 106 and equilibrate local pressure variations during shock loading. The flyer layer 108 helps prevent damage from thermal effects of the hot plasma plume 122 so that primarily mechanical shock is induced on the workpiece 104. To estimate the laser-induced shock pressure, a model disclosed in "Physical study of laser-produced plasma in confined geometry," R. Fabbro et al. (J. Appl. Phys. vol. 68, page 775 (1990)) can be used, which combines the effects of laser intensity, laser absorbance, vaporization of ablative coating, and the impedance of the confinement layer.

Figure 2:
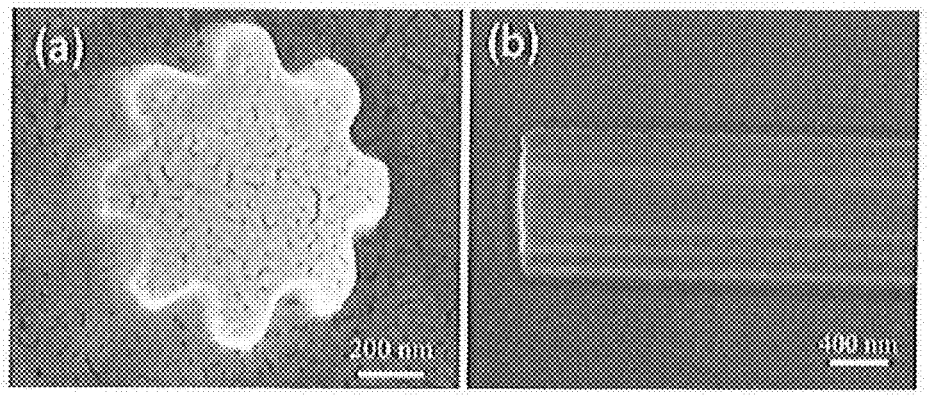
FIG. 2A is a scanning electron microscope (SEM) image of a 3D gear nanostructure formed from an aluminum film by laser nanoforming.
FIG. 2B is a SEM image of a 3D bench bar nanostructure formed from an aluminum film by laser nanoforming.

The metallic nanostructures generated by the laser nanoforming methods can be characterized using scanning electron microscopy (SEM) and atomic force microscopy (AFM). FIGS. 2A and 2B are representative SEM images of gears and benched bars with nanoscale details made by using silicon nanomolds. FIG. 2A shows a 3D gear nanostructure from an Al film obtained by laser nanoforming; the gear is about 1 μm with eight teeth having a tooth size of about 200 nm. FIG. 2B shows a benched bar nanostructure from an Al film obtained by laser nanoforming; the bar has a step height of about 50 nm and a stage width of about 200 nm. These images show that the laser nanoforming technique allows the direct and rapid formation of complex three-dimensional metallic features. The structures of silicon nanomold were faithfully replicated on metal film surfaces, and the mold after two times of use did not show obvious damage. Successful forming of these complex 3D nanostructures indicates that the plastic flow of metal film can easily flow into silicon nanomolds within tens of nanoseconds. It should be noted that the complex three-dimensional nanostructures are not easily fabricated by lithography-based techniques, where the quasi-3D shapes are based on projections of parallel sets of two-dimensional patterns. Multiple lithography and etch steps are usually required to generate three-dimensional structures, while laser nanoforming can create the same nanostructure with a one-step operation.

Figure 3:
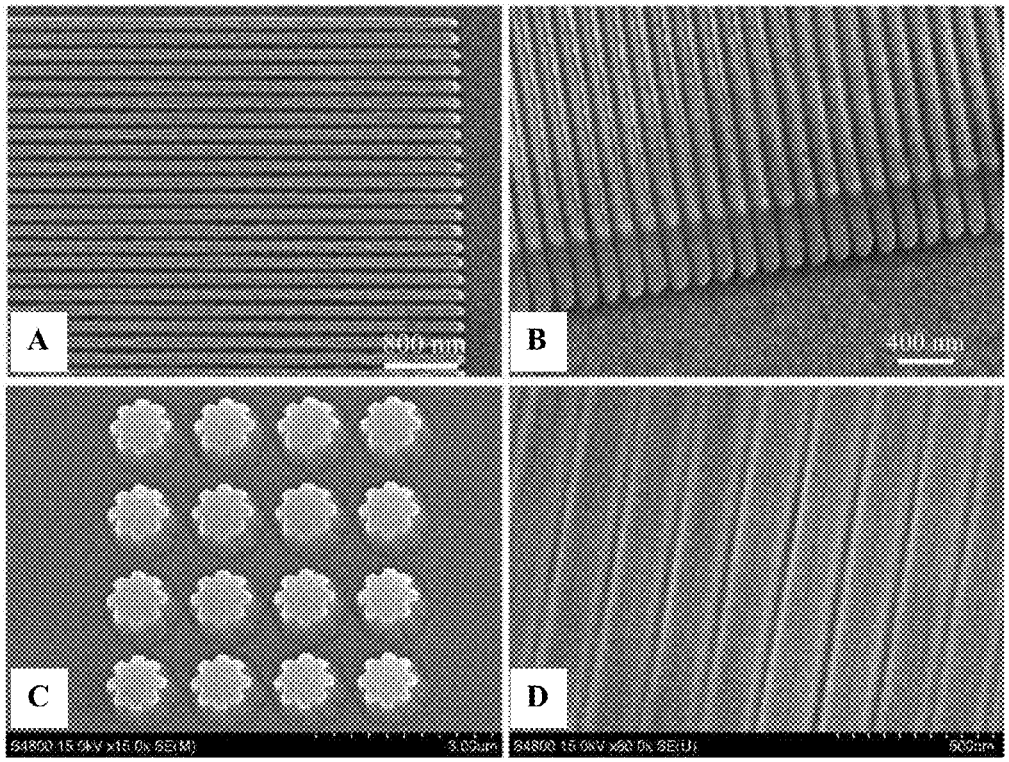
FIG. 3A is a SEM image of a high-precision nanostructure array on freestanding aluminum films of a uniform 150 nm period grating pattern formed by laser nanoforming.
FIG. 3B is a SEM image of a high-precision nanostructure array on freestanding aluminum films of a three-dimensional grating pattern with steps formed by laser nanoforming.
FIG. 3C is a SEM image of a high-precision nanostructure array on freestanding aluminum films of nanogears formed by laser nanoforming.
FIG. 3D is a SEM image of a high-precision nanostructure array on freestanding aluminum films of a uniform 180 nm period grating pattern formed by laser nanoforming.

Besides isolated three-dimensional nanostructures, laser nanoforming also can be used to pattern high-precision arrays of high spatial resolution structures, which shows great potential of this technique for mass production. FIG. 3A shows a pattern transfer of a uniform 150 nm period line array or grating pattern with trench widths of about 50 nm and bar widths of about 100 nm formed on an aluminum (Al) film surface. FIG. 3B shows the transfer array of a three-dimensional grating pattern with sharp steps having a step height of about 50 nm. FIG. 3C shows the transfer array of complex gear nanostructures of about 1 μm gears with about 200 nm teeth. FIG. 3D shows a uniform 180 nm period grating pattern with trench widths of about 30 nm and bar widths of about 150 nm. These patterns were formed using a laser intensity of 0.38 $GW/cm^2$. A sputtered Au—Pd layer of about 50 nm thickness was used as a dry lubricant for the nanostructure arrays of FIGS. 3A, 3B and 3C. A PVP layer coated by dip coating was used as a dry lubricant layer for the nanostructure array of FIG. 3D. Successful transfer of these high resolution arrays indicates that the plastic flow can uniformly flow over large areas under high pressure shock.

There is evidence that the thickness, composition and deposition method of the dry lubricant layer influences the final results of laser nanoforming. Without the dry lubricant layer, it is difficult to find any obvious deformation on Al films when feature sizes of molds are smaller than 500 nm. The dry lubricant layer reduces the friction constraint of plastic flow and assists the deformation of the workpiece during high-pressure shock loading. As a consequence, the plastic flow of the workpiece is easier to fill in the cavity and take the shape of the mold.

In an exemplary laser nanoforming system, three types of dry lubricant layers were compared: a sputtered Au—Cr film, an evaporated Au film and a dip-coated PVP film. All these dry lubricant films can increase the formability of an Al film, and thus high-resolution features (<50 nm) can be achieved for all these systems. It should be understood and appreciated herein that even higher resolution features are possible if nanomolds with smaller size cavities are used. Among the three types of dry lubricants, the evaporated Au film showed the best performance, while the dip-coated PVP film was found to be the least effective. It was determined that thick and smooth dry lubricant layers were more beneficial to deform the workpiece. However, there is a trade-off between advantages and disadvantages of decreasing friction between a workpiece and a mold. Though decreasing the friction is favorable for the moving of plastic flow, it also decreases the ability of securing the workpiece on the mold during shock. Therefore, if the dry lubricant is too thick and the friction is too small, it will become difficult to prevent the assembly from horizontal relative movement, which leads to the distortion of the formed features due to shear force. It was determined that a dry lubricant layer with a thickness ranging from about 20 nm to about 80 nm is particularly useful for laser nanoforming in the exemplary system.

Figure 4:
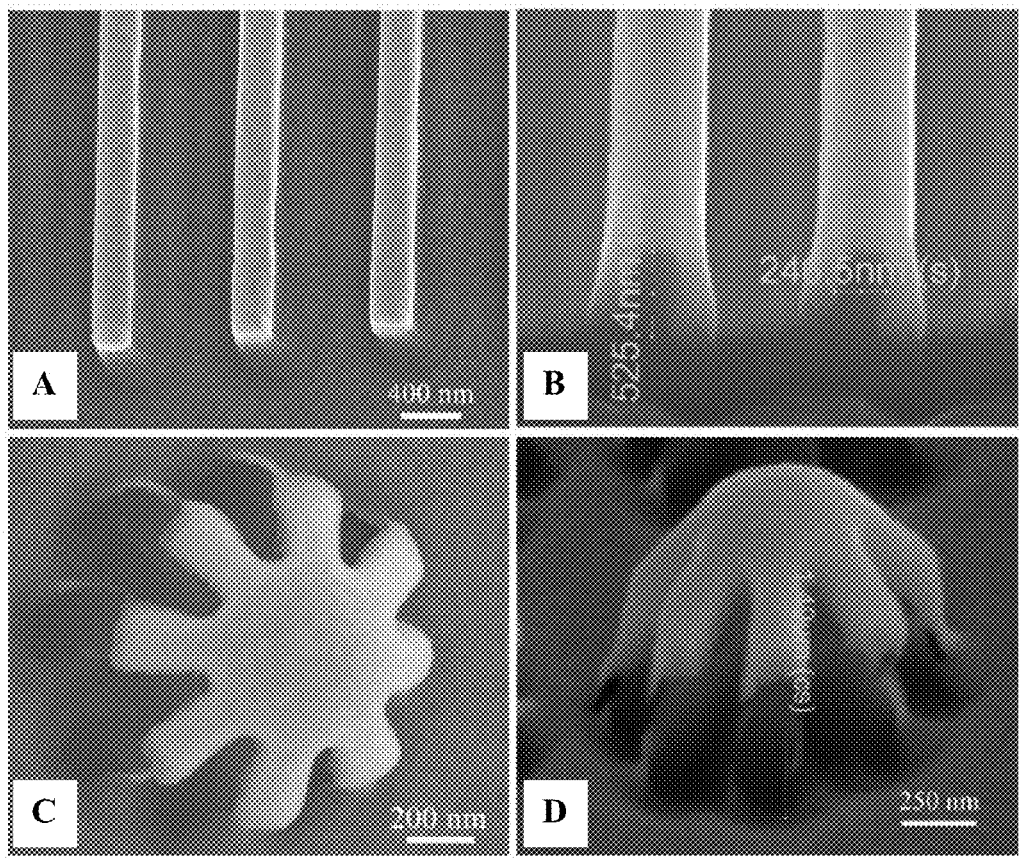
FIG. 4A is a SEM image of a high aspect-ratio nanostructure on freestanding aluminum films of a top-view of nanobars formed by laser nanoforming.
FIG. 4B is a SEM image of a high aspect-ratio nanostructure on freestanding aluminum films of a cross-sectional view of nanobars formed by laser nanoforming.
FIG. 4C is a SEM image of a high aspect-ratio nanostructure on freestanding aluminum films of a top view of a nanogear formed by laser nanoforming.
FIG. 4D is a SEM image of a high aspect-ratio nanostructure on freestanding aluminum films of a side view of a nanogear formed by laser nanoforming.

FIG. 4 shows SEM images of high aspect-ratio nanostructures on freestanding Al films formed by laser nanoforming. The laser intensity used to form these nanostructures was 0.46 $GW/cm^2$. An evaporated Au layer with a thickness of about 50 nm was used as the dry lubricant layer for these samples. FIG. 4A shows a top-view and FIG. 4B shows a cross-sectional view of nanobars. The semi-transparent coating layer is Pt that was used to protect the samples from damage during focus ion beam cutting. FIG. 4C is a top view and FIG. 4D is a side view of a nanogear.

During laser nanoforming, the formability of Al metals was observed to improve at nanoscale levels without the addition of material processing steps. Improving the formability of engineering materials is always an interesting topic for those within the materials science community. Different methods, including improving alloy cleanliness, careful chemistry and grain size control, and post-forming heat treatment, are usually utilized as a solution for limited formability. These methods can cause an increase in cost, while decreasing throughput effectiveness.

Figure 6:
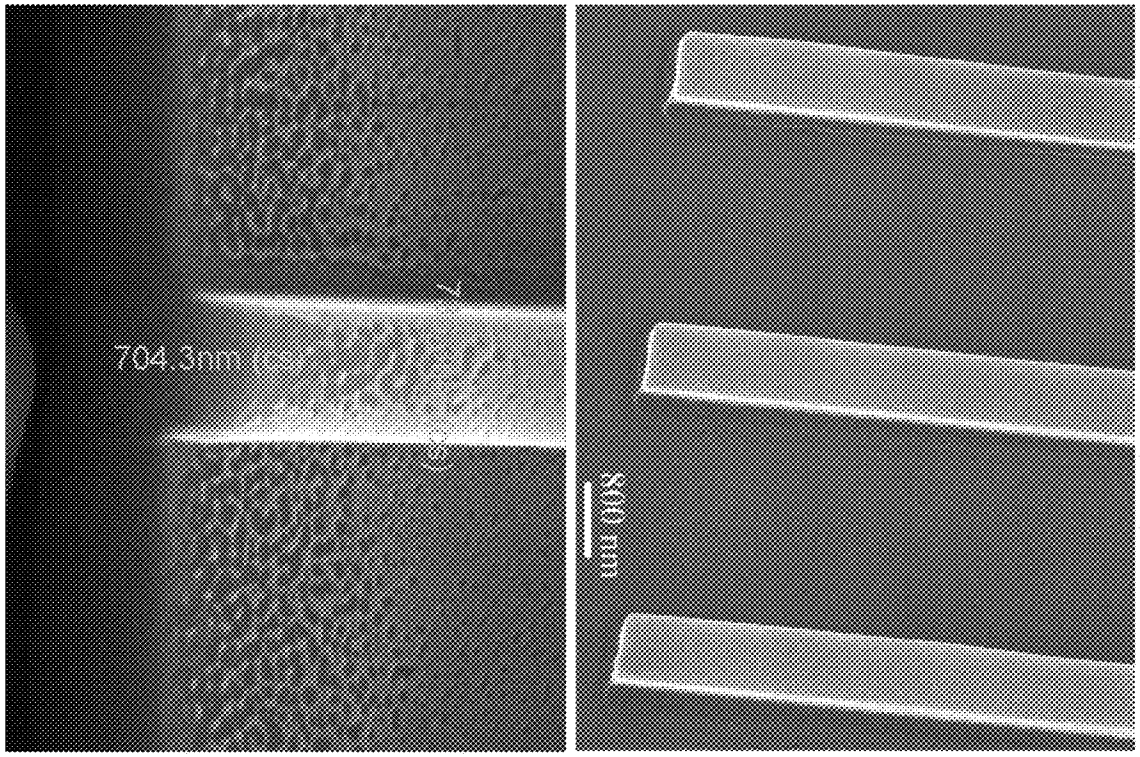
FIG. 6 shows SEM images of typical nanobars with shape corners that evidence high ductility.

FIG. 4A and FIG. 6 show typical SEM images of nanobars with shape corner, which evidences high ductility. It is noted that aluminum materials tend to fail at sharp corners when deformed during conventional processes due to poor formability at quasi-static conditions. FIGS. 4A, 4B and 6 show that the nanobars with high aspect ratio (height/width >2) can be obtained on Al films using the disclosed system and method. The smooth top surface and sharp sidewall of protruded bars (see FIGS. 4 and 6) results from the violent collision between Al plastic flow and the Si mold bottom or sidewall during high velocity deformation. It demonstrates that the Al plastic flow can fill into Si mold cavities even if the film undergoes large plastic deformation. The increase of ductility is more clearly shown in FIGS. 4C and 4D. While the initial thickness of the Al films were only about 1.4 μm, nanogears with height (about 1.5 μm) were achieved; while the tooth sizes of the nanogears were about 200 nm, and the final thickness of the Al film about 700 nm. It should be understood and appreciated herein that if molds with deeper cavities are used in laser nanoforming, features with higher aspect ratio may also be formed.

The curved top surface of the nanogear in FIGS. 4C and 4D is attributed to the curved bottom of the mold cavity, and particularly because of the limited ability of the focused ion beam (FIB) to fabricate deep cavities having a planar bottom. Taken together, these facts demonstrate that the formability of metal films was remarkably enhanced during the laser nanoforming process. The extended ductility for high strain rate processes, referred to as hyperplasticity, has been investigated over the past decade. Although there has not been a comprehensive understanding of high velocity formability, particularly as many factors can affect formability of metal, some important concepts are now understood. First, inertial effects are usually considered important contributors to improved formability, particularly as the acceleration of a material in the vicinity of a necking provides resistance to the propagation of the necking. Second, grain refinement, caused by high pressure shock, may also be responsible for improved formability because of reduced size effects. Experimental results have shown that materials with fine grains have a higher formability than those with coarse grains at small scale. It has been demonstrated that the mechanical boundary conditions of a workpiece are more important than the properties of materials for high strain rate deformation. The use of a dry lubricant can be regarded as an adjustment of boundary conditions for high velocity forming processes. As such, the combination of a high strain rate process and a low friction condition results in an increase of the forming limit for the laser nanoforming method.

FIGS. 4C and 4D reveal that the sudden large deformation induces the fracture of the lubricant layer, while the broken layer keeps the top-view shape of the nanomold. Such a result suggests that a nanoscale mechanical cutting technique can be developed from the present laser nanoforming concept. Furthermore, experimental access to nanostructures by laser nanoforming enables the study of fundamental aspects of metallic plastic deformation at extremely small scales. For example, the deformation of a thin lubricant layer during laser nanoforming is clearly recorded in the SEM images.

Figure 5:
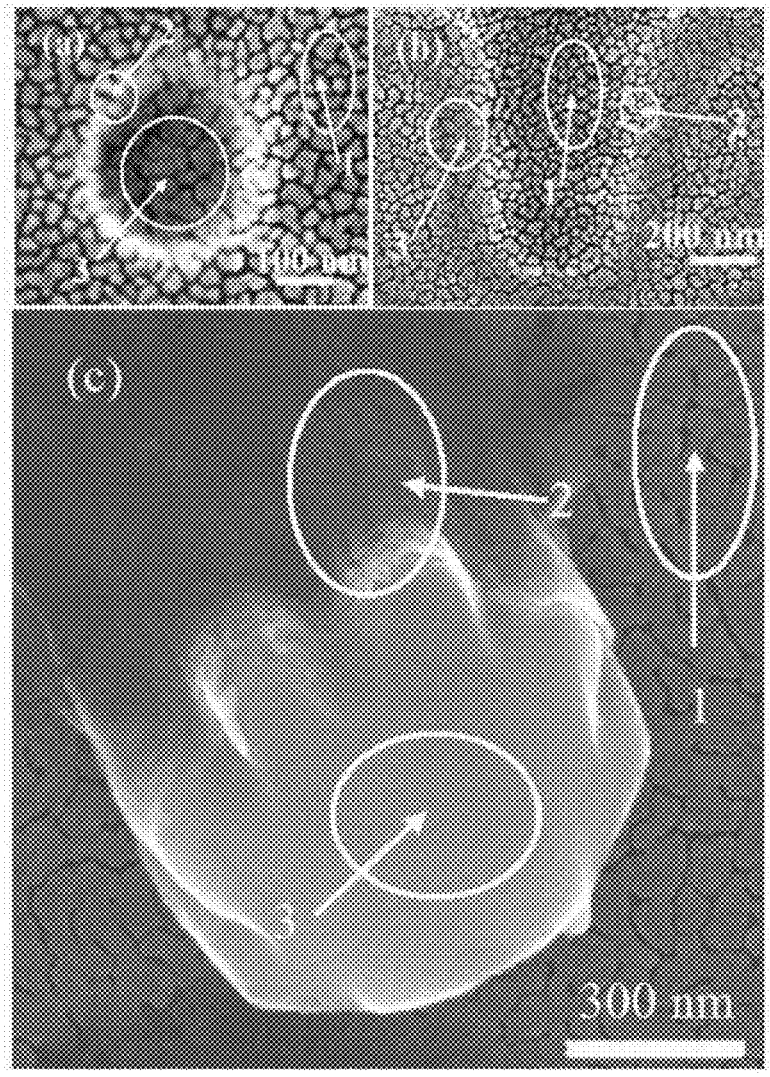
FIG. 5A is an SEM image of Au—Cr grains on an Al film that has undergone high velocity indentation by a Si pillar with about a 200 nm diameter.
FIG. 5B is an image of one tooth of a nanogear after a forming operation where the laser intensity was not high enough to drive the film colliding with the bottom of the mold cavity.
FIG. 5C is an image of one protruded nanogear after a forming operation where the laser intensity was high enough to drive the film colliding with the bottom of the mold cavity.

FIG. 5A is an SEM image of Au—Cr grains on an Al film that has undergone high velocity indentation by a Si pillar with about a 200 nm diameter. For the Au—Cr lubricant layer out of the indentation area (area 1), no obvious grain size variation was observed. Around the rim of the deformed cavity (area 2), the refinement of Au—Cr grains because of severe bending, shearing, stretching and necking was observed, while at the bottom of the deformed cavity (area 3), the obvious tangential enlargement of Au—Cr grain was observed due to the stretching under shock compression.

FIG. 5B exhibits one tooth of a nanogear after the forming operation, where the laser intensity is not high enough to drive the film colliding with the bottom of the mold cavity. Thus, the grain sizes at area 1 are the same as those before forming. When plastic flow sinks toward the mold cavity during forming, the material closely contacting with the rim of the mold cavity (area 3) undergoes the maximal compressive and tensile stress due to the friction constraint. Thus, obvious tangential enlargement of Au—Cr grains can be observed at area 3.

Similar to the above sample, the grain refinement was also observed at the edge of the formed tooth (area 2). FIG. 5C exhibits one protruded nanogear after a forming operation, where the laser intensity was high enough to drive the film colliding with the bottom of the mold cavity. The grain size of the lubricant layer out of indentation area (area 1) is similar to those without a shock loading. However, dramatic elongation and fracture of Au grains was observed on the sidewall of the formed nanogear (area 2), which is due to the violent abrasion between the workpiece and sidewall of the mold. The smooth top surface with decreased Au grain size may be caused by the severe collision between the high velocity plastic flow and the bottom of the mold cavity.

The laser nanoforming techniques disclosed herein are effective at improving the formability and mechanical properties of metal film by a combination of low friction and high strain rate processes. Complex three-dimensional metallic nanostructures can be readily achieved by this method, even though conventional lithography and etching techniques struggle to obtain nanostructures. The method has multiple advantages in terms of simplicity, convenience and stability. First, the resolution of this mechanical process depends on the mold feature size and is not limited by the diffraction of light or the photoresist and development. Second, the setup of the laser nanoforming technique is simple, does not require a heating system, a vacuum system and/or a complex optics system. Third, because the processes can imprint complex 3D structures on functional materials with one step, the number of processing steps is reduced. Additionally, using mature laser techniques in laser nanoforming (LNF) can enable the process to have high speed (less than 100 nanoseconds), well-controlled pressure (from hundreds of MPa to tens of GPa), and high precision (spot diameter from several micrometers to millimeters). Flexibility of the laser technique also makes it easy to be integrated into other manufacturing processes and to combine the advantages of different methods, particularly as laser induced compressive shock waves are not be blocked by tools and molds, which make it possible to form freestanding film as a whole. Because the high velocity forming is more effective for low ductility material, the method can be extended to other materials, such as multiple-layer function materials. Even some brittle and hard-to-form materials may be deformed by LNF.

While exemplary embodiments incorporating the principles of the present invention have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains.

What is claimed is:

1. A method for forming three-dimensional nanostructures, the method comprising:

directing a laser beam along an optical path to hit an ablative layer;

causing the ablative layer to vaporize into plasma and explode due to the laser beam, the exploding ablative layer generating a shockwave;

confining the shockwave;

subjecting a metallic surface to the shockwave; and exerting a force on the metallic surface with the shockwave to form an inverse three-dimensional nanostructure of an underlying mold.

2. The method of claim 1, further comprising reducing friction between the metallic surface and the underlying mold using a dry lubricant.

3. The method of claim 2, wherein confining the shockwave comprises using a confinement layer substantially transparent to the laser beam to confine the shockwave, the ablative surface being between the confinement layer and the metallic surface.

4. The method of claim 3, further comprising using a cushion layer to protect the underlying mold from damage.

5. The method of claim 3, further comprising using a flyer layer to protect the metallic surface from thermal effects of the exploding ablative layer.

6. The method of claim 3, further comprising controlling the beam size of the laser beam using a focus lens in the optical path.

7. The method of claim 3, wherein the underlying mold includes feature sizes less than 500 nm.

8. The method of claim 3, wherein the underlying mold is a nanomold made of silicon.

9. The method of claim 3, wherein the metallic surface is an aluminum film surface.

10. The method of claim 3, wherein the dry lubricant is one of a sputtered Au—Cr film, an evaporated Au film and a dip-coated PVP film.

11. A laser nanoforming system for forming three-dimensional nanostructures, the laser nanoforming system comprising:

an underlying nanomold;

an ablative layer;

a metallic surface located between the ablative layer and the underlying nanomold;

a laser generating a laser beam to hit the ablative layer and cause the ablative layer to vaporize into plasma and explode to generate a shockwave;

wherein the shockwave exerts a force on the metallic surface to form an inverse three-dimensional nanostructure of the underlying nanomold.

12. The laser nanoforming system of claim 11, further comprising a dry lubricant layer between the metallic surface and the underlying nanomold, the dry lubricant layer reducing friction between the metallic surface and the underlying nanomold.

13. The laser nanoforming system of claim 12, further comprising a confinement layer substantially transparent to the laser beam for confining the shockwave, the ablative surface being between the confinement layer and the metallic surface.

14. The laser nanoforming system of claim 13, further comprising a cushion layer to protect the underlying mold from damage, the underlying mold being between the metallic surface and the cushion layer.

15. The laser nanoforming system of claim 13, further comprising a flyer layer to protect the metallic surface from thermal effects of the exploding ablative layer, the flyer layer being between the ablative layer and the metallic surface.

16. The laser nanoforming system of claim 13, wherein the underlying nanomold includes feature sizes less than 500 nm.

17. The laser nanoforming system of claim 13, wherein the underlying nanomold is made of silicon.

18. The laser nanoforming system of claim 13, wherein the metallic surface is an aluminum film surface.

19. The laser nanoforming system of claim 13, wherein the dry lubricant layer comprises one of a sputtered Au—Cr film, an evaporated Au film and a dip-coated PVP film.

20. The laser nanoforming system of claim 19, wherein the thickness of the dry lubricant layer is between 20 nm and 80 nm.

* * * * *